US010654646B1

(12) United States Patent
Lin

(10) Patent No.: US 10,654,646 B1
(45) Date of Patent: May 19, 2020

(54) CONTAINING APPARATUS FOR ELIMINATING BRIDGING

(71) Applicant: Suncue Company Ltd., Taichung (TW)

(72) Inventor: Jung-Lang Lin, Taichung (TW)

(73) Assignee: SUNCUE COMPANY LTD., Taichung (TW)

( * ) Notice: Subject to any disclaimer, the term of this patent is extended or adjusted under 35 U.S.C. 154(b) by 0 days.

(21) Appl. No.: 16/372,011

(22) Filed: Apr. 1, 2019

(51) Int. Cl.
*B65D 88/70* (2006.01)

(52) U.S. Cl.
CPC ..... *B65D 88/703* (2013.01)

(58) Field of Classification Search
CPC ..... B65D 88/703; B65D 88/70; B65D 88/72
USPC ..... 222/195; 366/106
See application file for complete search history.

(56) References Cited

U.S. PATENT DOCUMENTS 1,971,852 A * 8/1934 Goebels ..... B01F 13/02 366/107
2,170,258 A * 8/1939 Borch ..... B65D 88/72 222/202
2,331,208 A * 10/1943 Ludi ..... G01F 23/161 73/302
2,353,346 A * 7/1944 Logan ..... B65D 88/706 406/88
2,665,035 A * 1/1954 Schemm ..... B65D 88/72 222/195
2,884,230 A * 4/1959 Pyle ..... B01F 13/0233 366/106
3,097,828 A * 7/1963 Grun ..... B01F 13/0261 366/106
3,121,593 A * 2/1964 McIlvaine ..... B65G 53/22 406/137
3,862,707 A * 1/1975 Reiter ..... B01F 13/0283 366/101
3,942,689 A * 3/1976 Dakin, Jr. ..... B65D 88/70 222/195
3,952,956 A * 4/1976 Steele ..... B08B 5/02 239/289
3,955,717 A * 5/1976 Landau ..... B65D 88/70 222/195
4,198,210 A * 4/1980 Worley ..... B01J 8/1818 222/195
4,325,495 A * 4/1982 Mokris ..... B65D 88/703 222/1
4,469,247 A * 9/1984 Tompkins ..... B65D 88/703 137/199
4,496,076 A * 1/1985 Tompkins ..... B65D 88/703 222/195
4,767,024 A * 8/1988 Rappen ..... B65D 88/703 222/195

(Continued)

FOREIGN PATENT DOCUMENTS

WO WO-2006096092 A1 * 9/2006 ..... B65D 88/703

*Primary Examiner* — Benjamin R Shaw
(74) *Attorney, Agent, or Firm* — Thomas J. Nikolai; DeWitt LLP

(57) ABSTRACT

A containing apparatus for eliminating bridging has a body and a pulse module. The body has a chamber formed inside. The pulse module is connected with the body, and has at least one nozzle and an air supply. The at least one nozzle is connected to the body. The air supply is connected to the at least one nozzle, and is able to pulse gas into the chamber of the body. By utilizing air pulse to collapse a piled arch structure of contents, bridging in the chamber may be eliminated.

4 Claims, 7 Drawing Sheets

(56) References Cited

U.S. PATENT DOCUMENTS

| | | | | | |
|---|---|---|---|---|---|
| 4,767,036 | A * | 8/1988 | Schleimer | B22D 1/005 | 222/195 |
| 4,941,779 | A * | 7/1990 | Dewitz | B01J 3/02 | 222/195 |
| 5,017,053 | A * | 5/1991 | Sisk | B01F 13/0255 | 366/101 |
| 5,129,766 | A * | 7/1992 | Dirkse | B01J 8/0015 | 222/195 |
| 5,507,602 | A * | 4/1996 | Walker | B65B 69/0075 | 222/195 |
| 7,731,411 | B2 * | 6/2010 | Pessin | B01F 3/18 | 366/106 |
| 8,387,824 | B2 * | 3/2013 | Wietgrefe | B65D 88/30 | 222/1 |
| 2008/0279641 | A1 * | 11/2008 | Critelli | B65D 88/703 | 406/137 |
| 2009/0272829 | A1 * | 11/2009 | Migliorati | B65D 88/703 | 241/39 |
| 2011/0017786 | A1 * | 1/2011 | Hamel | B01J 8/1818 | 222/630 |
| 2012/0208453 | A1 * | 8/2012 | Simoens | B65D 88/703 | 455/15 |
| 2015/0086306 | A1 * | 3/2015 | Richard | B65D 88/72 | 414/288 |
| 2016/0376098 | A1 * | 12/2016 | Cain | B65D 88/72 | 414/288 |
| 2017/0022000 | A1 * | 1/2017 | Steele | B65D 88/703 | |
| 2017/0234533 | A1 * | 8/2017 | Lin | F23J 1/06 | 110/165 R |
| 2017/0354936 | A1 * | 12/2017 | Hsu | B65D 88/72 | |

* cited by examiner

CONTAINING APPARATUS FOR ELIMINATING BRIDGING

BACKGROUND OF THE INVENTION

1. Field of the Invention

The present invention relates to a containing apparatus, and more particularly to a containing apparatus that may eliminate bridging of contents.

2. Description of Related Art

With reference to FIG. 7, when a conventional containing apparatus 90 is discharging, bridging may occur and cause a problem. Particles, which are contained in the conventional containing apparatus 90, may pile up near an exit due to friction or viscosity, and form an arch structure B. Subsequently, particles located at higher positions may be obstructed by the arch structure B and could not be discharged.

As a conventional method to eliminate bridging such as the arch structure B, a stirring device such as a stirring rod is disposed in the conventional containing apparatus 90. Stirring may disturb and stop the particles from piling into the arch structure B, so the bridging may be eliminated.

Vibration is another common way to eliminate bridging. A vibrating device, e.g., a vibration motor or an air hammer, may be disposed on an outer surface of the conventional containing apparatus 90. The vibrating device may vibrate side walls of the conventional containing apparatus 90, and support points at where the particles contact an inner surface of the conventional containing apparatus 90 may be broken. As a result, the particles are unable to pile into the arch structure B, and the bridging is eliminated.

However, either of the above-mentioned two conventional methods utilizes a mechanical operation on the arch structure B to eliminate the bridging, and thereby has the following shortcomings.

1. The stirring device mainly works in a restricted area due to rotations of mechanisms. That is to say, the effect of bridging elimination is confined and only provided in the restricted area.

2. Bridging may occur to a variety of containing apparatuses, but stirring is not a suitable method for all of them. For example, the stirring device may be used in a storage silo, but it cannot be disposed in a burning furnace. The burning furnace burns biomass fuel for generating energy, and ashes would be collected in or emitted from a furnace base of the burning furnace. The stirring device would be burned or damaged in the burning furnace.

3. On the other hand, after a long-term use of the vibrating device, the containing apparatus 90 may suffer fatigue failure or wear in partial structure.

To overcome the shortcomings, the present invention tends to provide a containing apparatus to mitigate or obviate the aforementioned problems.

SUMMARY OF THE INVENTION

The main objective of the present invention is to provide a containing apparatus that may eliminate bridging of contents in a way of a non-contact operation, instead of the mechanical methods that cause the aforementioned problems.

The containing apparatus for eliminating bridging has a body and a pulse module. The body has a chamber formed inside. The pulse module is connected with the body, and has at least one nozzle and an air supply. The at least one nozzle is connected to the body. The air supply is connected to the at least one nozzle, and is able to pulse gas into the chamber of the body via the at least one nozzle.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
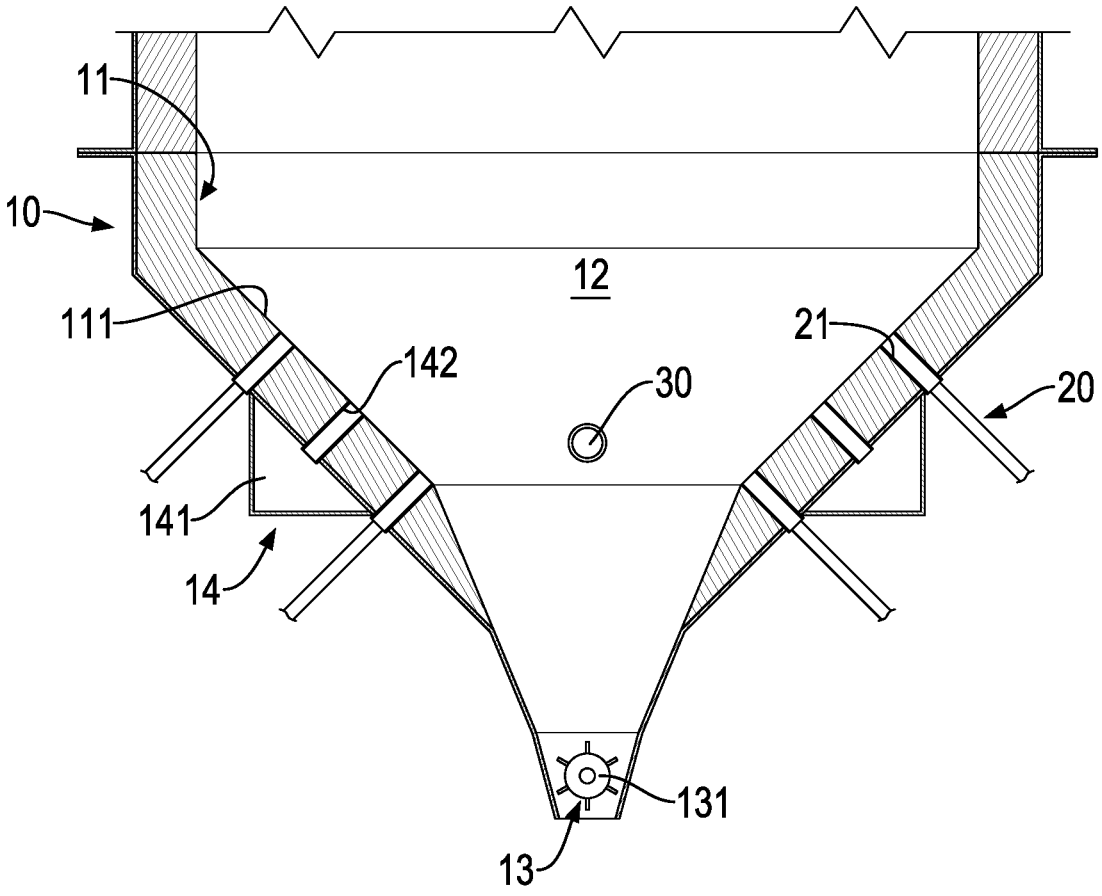
FIG. 1 is a side view in partial section of a containing apparatus for eliminating bridging in accordance with the present invention.
Figure 2:
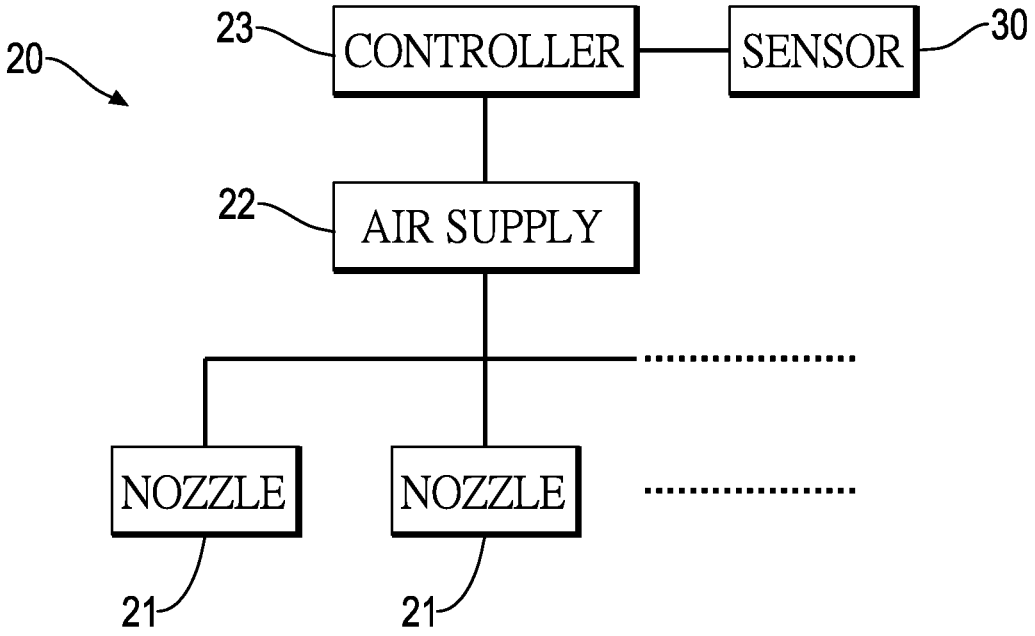
FIG. 2 is a block diagram of a pulse module of the containing apparatus in FIG. 1.

With reference to FIGS. 1 and 2, a containing apparatus for eliminating bridging in accordance with the present invention has a body 10 and a pulse module 20.

The body 10 may be a storage silo, a furnace base of a burning furnace, or other apparatuses that may contain or store materials. The body 10 has an interior surface 11, a chamber 12, a discharge portion 13, and a ventilator 14. The chamber 12 is surrounded by the interior surface 11 inside the body 10, and contents such as biomass fuel may be contained therein. In a preferred embodiment of the present invention, the interior surface 11 gradually tapers inwardly toward a bottom of the body 10, and forms a guiding incline 111 at the bottom of the body 10. The discharge portion 13 is located at the bottom of the body 10, and communicates with the chamber 12. If the body 10 is the furnace base, the discharge portion 13 may have a discharge shaft 131. The discharge shaft 131 is rotatably mounted to the body 10 so as to discharge the contents in the discharge portion 13.

The ventilator 14 is selectively mounted to the body 10, and has at least one casing 141 and at least one through hole 142. In the present invention, the ventilator 14 has two casings 141 and multiple through holes 142. The two casings 141 cover two sides of an exterior surface of the body 10, and each one of the two casings 141 has an enclosed space. The multiple through holes 142 are disposed through the interior surface 11 and the exterior surface of the body 10, and each one of the multiple through holes 142 communicates with the chamber 12 and the enclosed space of a respective one of the two casings 141. In addition, the two casings 141 may be connected with a blower, and air flow provided by the blower may enter the chamber 12 via the multiple through holes 142. The two casings 141 are respectively located outside the guiding incline 111 of the body 10, and the multiple through holes 142 are disposed through the guiding incline 111 of the interior surface 11.

With reference to FIGS. 1 and 2, the pulse module 20 is connected with the body 10, and has at least one nozzle 21, an air supply 22, and a controller 23. In the present invention, the pulse module 20 has multiple nozzles 21 disposed through the interior surface 11 and the exterior surface at spaced intervals and communicating with the chamber 12 of the body 10. Furthermore, the multiples nozzles 21 are located near the multiple through holes 142. The air supply 22 is connected with the multiple nozzles 21, so as to pulse gas such as high-pressure air or vapor into the chamber 12. The controller 23 is electrically connected to the air supply 22. Through the controller 23, the personnel can activate the air supply 22 randomly or at regular time, so gas may be pulsed into the chamber 12 via the multiple nozzles 21.

Air pulses may be provided into the chamber 12 of the body 10. to eliminate bridging by the multiple nozzles 21 of the pulse module 20. Moreover, in the present invention, the containing apparatus for eliminating bridging may further has at least one sensor 30, and one sensor 30 is used for description in the following paragraphs.

With reference to FIGS. 1 and 2, the sensor 30 is selectively mounted in the chamber 12 on the interior surface 11 of the body 10, and the sensor 30 is connected to the controller 23 of the pulse module 20 via signals. The sensor 30 may be an ultrasonic sensor, a photoelectric sensor, or a temperature sensor, so as to detect whether bridging has occurred in the chamber 12.

In the present invention, the sensor 30 is mounted on the guiding incline 111 near the bottom of the body 10. Bridging tends to occur at where a horizontal sectional area of the chamber 12 tapers, that is, a place near the discharge portion 13 of the body 10. Consequently, the sensor 30 located on the guiding incline 111 is more likely to succeed in detecting bridging particles of the contents.

Figure 3:
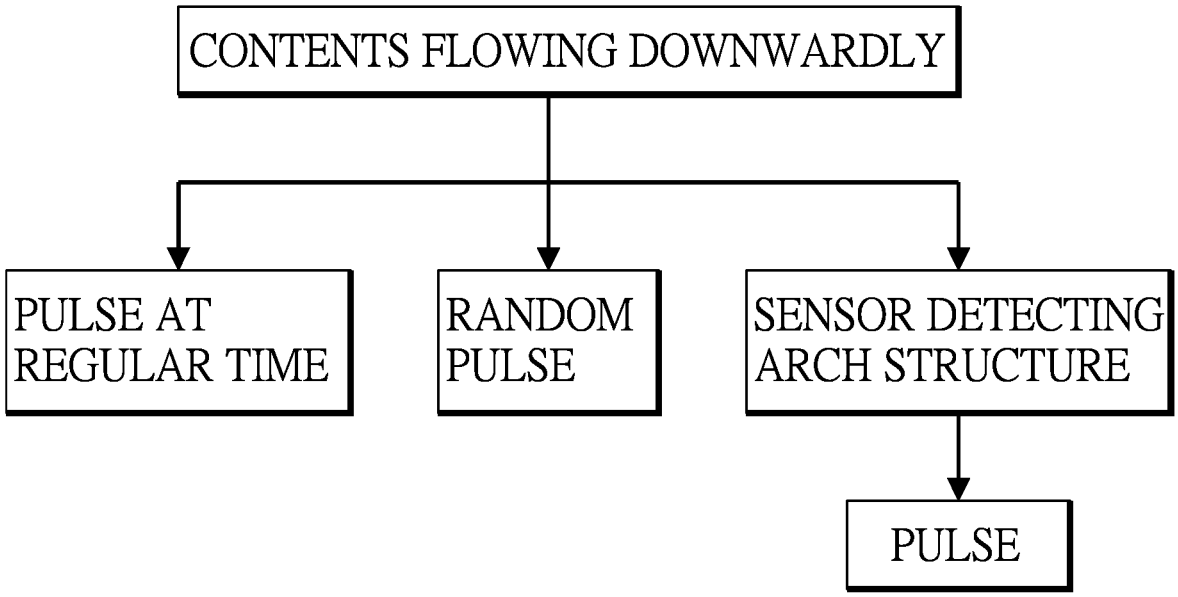
FIG. 3 is a process flow diagram to illustrate an operation of the containing apparatus in FIG. 1.
Figure 4:
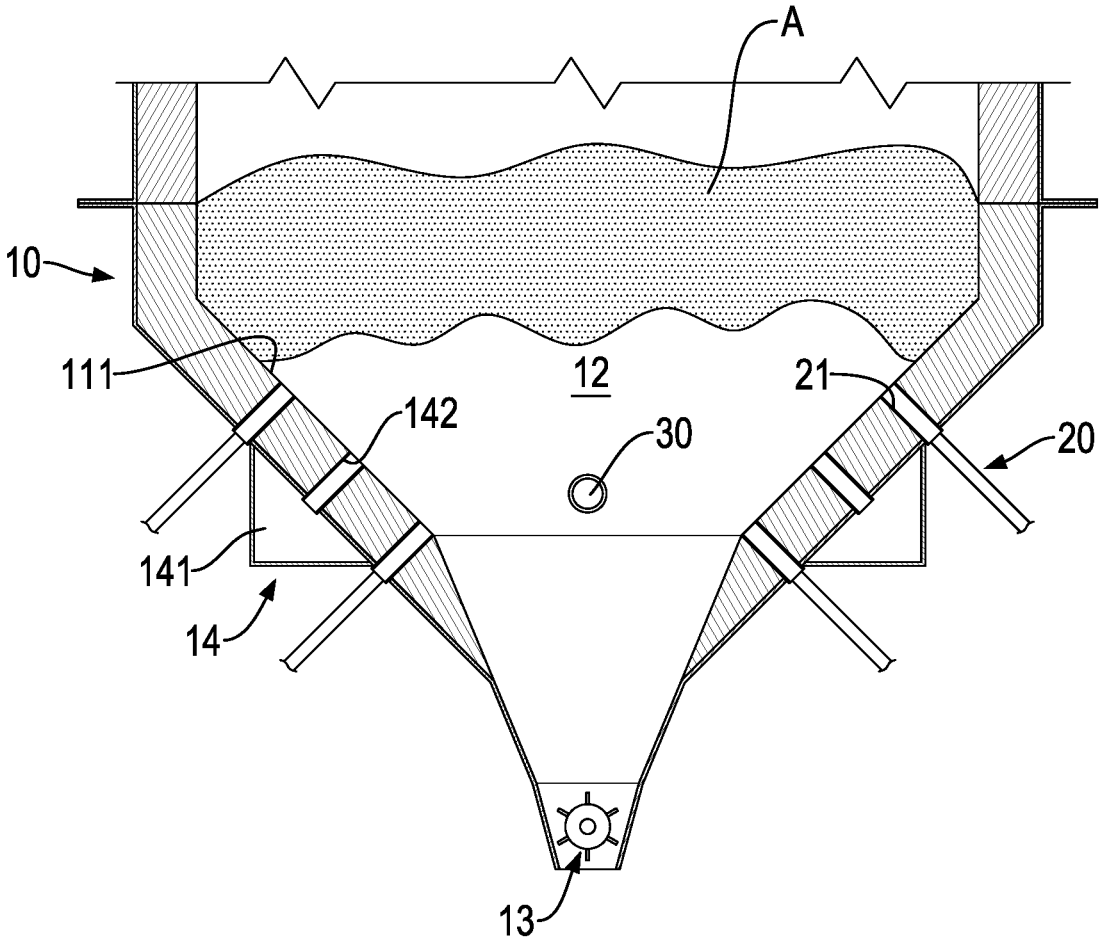
FIG. 4 is a side view in partial section of the containing apparatus in FIG. 1, shown with bridging formed in the containing apparatus.

With reference to FIGS. 3 to 6, when the bridging occurs, the particles are formed into an arch structure A as shown in FIG. 4. Particles above the arch structure A would be blocked and cannot flow downwardly after particles below have been discharged, and a bottom of the chamber 12 thereby becomes hollow. As the sensor 30 detects such condition and sends a signal to the controller 23 to activate the air supply 22, the gas such as vapor or high-pressure air may be pulsed into the chamber 12 through the at least one nozzle 21, and collapses the arch structure A. Eventually the contents in the chamber 12 may continue to be discharged.

Figure 5:
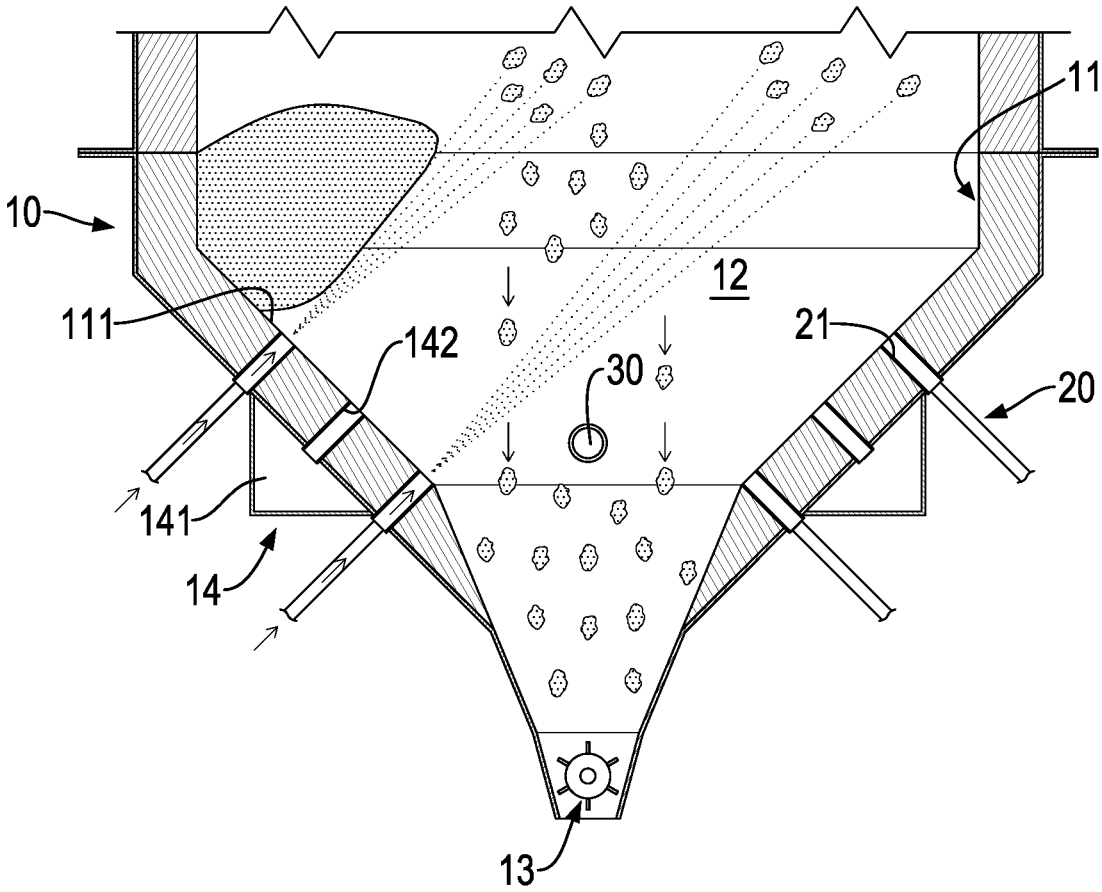
FIGS. 5 and 6 are operational side views in partial section of the containing apparatus in FIG. 1, for eliminating bridging.
Figure 6:
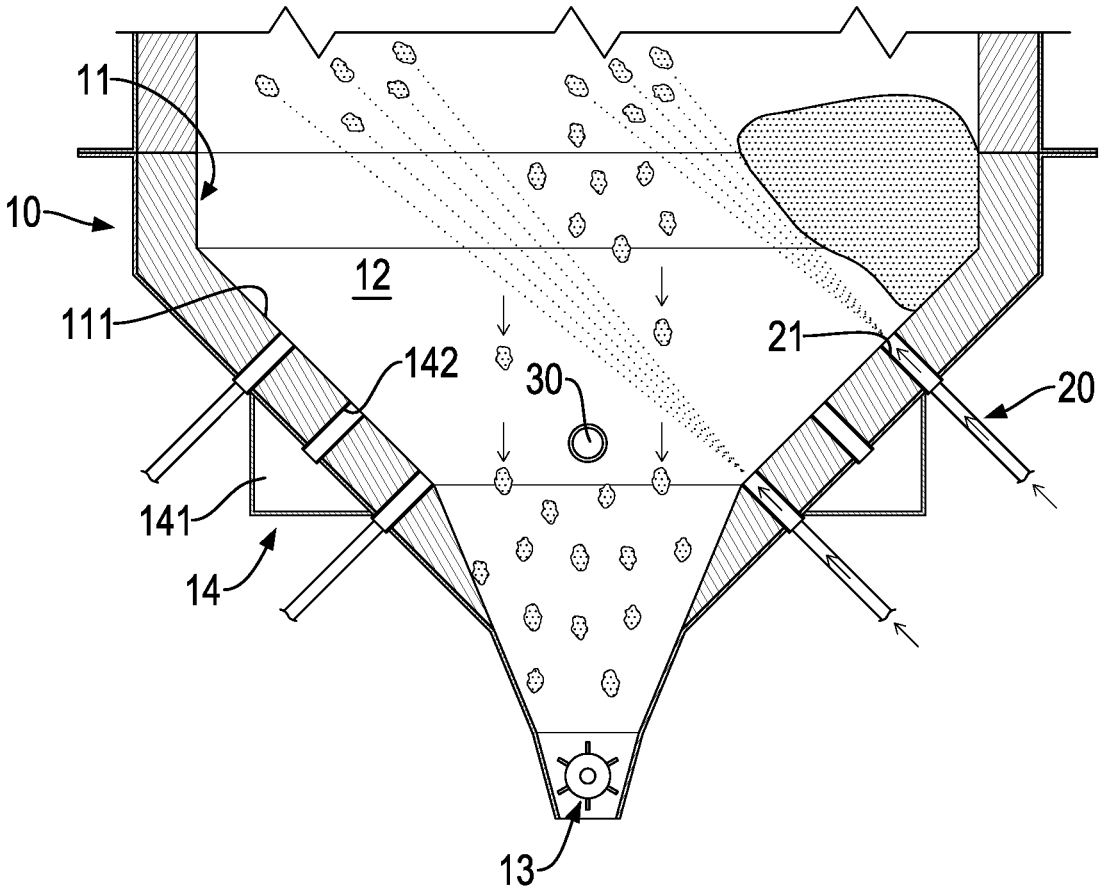
Figure 7:
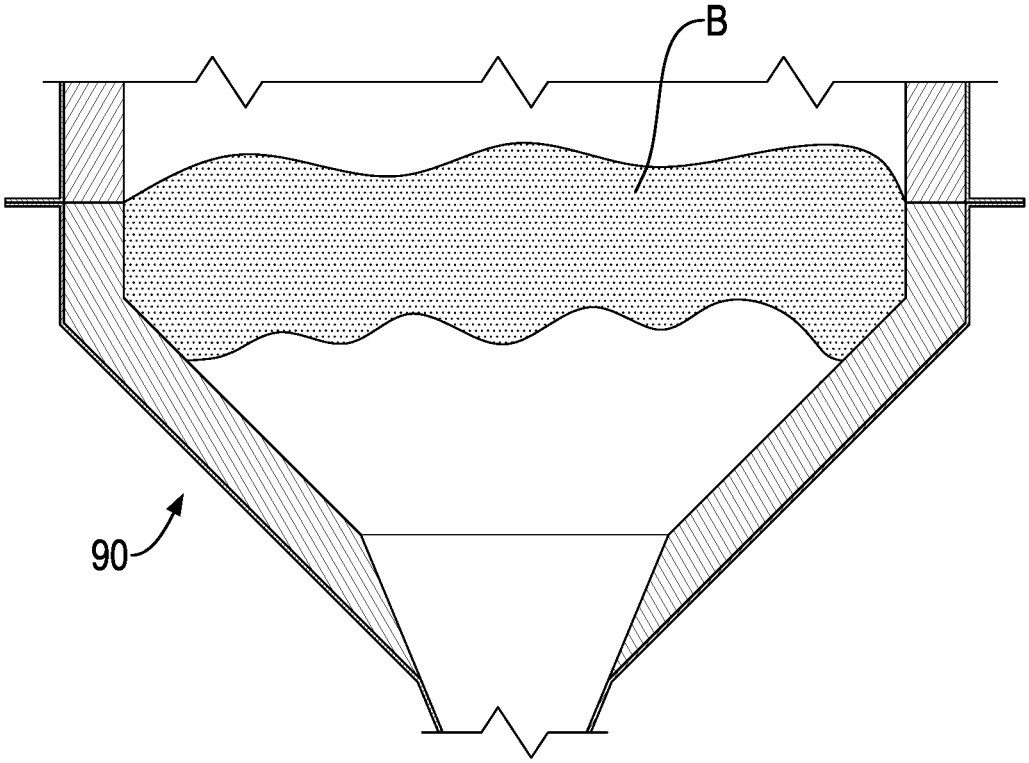
FIG.7 PRIOR ART
FIG. 7 is a side view in partial section of a containing apparatus in accordance with the prior art, showing bridging in the containing apparatus.

Moreover, with reference to FIGS. 5 and 6, the multiple nozzles 21 through the guiding incline 111 of the body 10 may pulse gas from a left side, from a right side, or even from the two sides at the same time. If the gas is provided persistently, a flow field designed for discharging the contents in the chamber 12 may be inadvertently changed. Therefore, the gas should be provided in pulses.

With reference to FIG. 3, besides passively activated by the sensor 30, the air supply 22 may also be activated manually, or be activated randomly or at regular time under direct command of the controller 23.

Additionally, an amount and positions on the body 10, and pulsing angles of the nozzles 21 may be changed according to a configuration of the containing apparatus or properties and sizes of the contents. Also, each one of the multiple nozzles 21 has a mouth that is circular, flat, or in any applicable shape for providing suitable air pulse to break the arch structure A that may be piled up according to the flow field.

When the body 10 is the furnace base of the burning furnace, the blower communicating with the ventilator 14 may provide air flowing into the chamber 12 via the casings 141 and the through holes 142. Because the multiple through holes 142 and the multiple nozzles 21 are arranged closely, the air flowing through the through holes 142 may partially cool down the furnace base at a neighborhood of the multiple nozzles 21, and the nozzles 21 may be prevented from being damaged under high temperature.

To sum up, the personnel may utilize air pulse to eliminate bridging with the air supply 22 activated manually, at regular time, randomly, or passively by signals, so that the contents may be discharged smoothly. By the technical characteristics of the present invention, the problems of the restriction on types of the containing apparatus, and harm to the containing apparatus such as burning and fatigue are also solved.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A containing apparatus for eliminating bridging comprising:

a body being a furnace base of a burning furnace, tapering inwardly toward a bottom of the body, and having
at least one nozzle connected to the body;
a chamber formed inside the body; and
a ventilator comprising
at least one casing covering an exterior surface of the body and having an enclosed space; and
at least one through hole communicating with the chamber and the enclosed space, and located near the at least one nozzle; and
a pulse module connected with the body; and
an air supply connected to the at least one nozzle and being able to pulse gas into the chamber of the body;
wherein the at least one through hole and the at least one nozzle are arranged so that air flowing through the at least one through hole may partially cool down the furnace base at a location surrounding the at least one nozzle.

2. The containing apparatus for eliminating bridging as claimed in claim 1, wherein the pulse module has
a plurality of said nozzles respectively connected to the body and the air supply; and
the ventilator has
two said casings, each one of the two casings covering a respective one of two sides of the exterior surface of the body; and
multiple said through holes disposed separately and located near the plurality of nozzles, each one of the multiple through holes communicating with the chamber and the enclosed space of a respective one of the two casings.

3. The containing apparatus for eliminating bridging as claimed in claim 1, wherein the body has a discharge portion located at the bottom of the body, communicating with the chamber, and having a discharge shaft rotatably mounted to the body.

4. The containing apparatus for eliminating bridging as claimed in claim 2, wherein the body has a discharge portion located at the bottom of the body, communicating with the chamber, and having a discharge shaft rotatably mounted to the body.

* * * * *